United States Patent [19]

Nouel

[11] Patent Number: 4,857,436

[45] Date of Patent: Aug. 15, 1989

[54] OFFSET PLATES WITH TWO CHROMIUM LAYERS

[76] Inventor: Jean-Marie Nouel, 67 rue Miromesnil 75008, Paris, France

[21] Appl. No.: 245,658

[22] Filed: Sep. 15, 1988

Related U.S. Application Data

[63] Continuation of Ser. No. 138,289, Dec. 28, 1987, abandoned, which is a continuation of Ser. No. 481,766, Apr. 4, 1983, abandoned, which is a continuation of Ser. No. 168,003, Jul. 14, 1980, abandoned.

[51] Int. Cl.[4] ..... B41N 1/08

[52] U.S. Cl. ..... 430/276; 430/275; 101/458

[58] Field of Search ..... 430/275, 276; 101/458

[56] References Cited

U.S. PATENT DOCUMENTS

| | | | |
|---|---|---|---|
| 748,004 | 12/1903 | Pancost . | |
| 1,215,494 | 2/1917 | Cornwall . | |
| 1,975,239 | 10/1934 | Ungelenk . | |
| 2,004,824 | 6/1935 | MacLean . | |
| 2,584,317 | 2/1952 | Aller . | |
| 2,627,299 | 5/1954 | Geese et al. . | |
| 2,907,273 | 10/1959 | Geese . | |
| 3,161,508 | 12/1964 | Hepner . | |
| 3,188,186 | 6/1965 | Durham | 428/613 |
| 3,280,736 | 10/1966 | Schafler et al. . | |
| 3,289,578 | 12/1966 | Grosso . | |
| 3,461,048 | 8/1969 | Mahlstedt et al. | 204/41 |
| 3,660,252 | 5/1972 | Giori . | |
| 3,979,212 | 9/1976 | Peters . | |
| 4,115,127 | 9/1978 | Ikeda . | |
| 4,287,288 | 9/1981 | Pigeon et al. | 204/41 |
| 4,301,229 | 11/1981 | Sakaki . | |

FOREIGN PATENT DOCUMENTS

| | | |
|---|---|---|
| 79603 | 7/1978 | Japan . |
| 132294 | 10/1980 | Japan . |
| 160196 | 9/1983 | Japan . |
| 48190 | 3/1984 | Japan . |
| 475902 | 11/1937 | United Kingdom . |
| 925961 | 5/1963 | United Kingdom . |
| 936913 | 9/1963 | United Kingdom . |
| 1172517 | 12/1969 | United Kingdom . |
| 1187785 | 4/1970 | United Kingdom . |

OTHER PUBLICATIONS

IBM Tech. Disc. Bulletin, vol. 26, No. 1, Jun. 1983, Junginger; p. 274.

*Primary Examiner*—Clifford D. Crowder
*Attorney, Agent, or Firm*—DeLio & Associates

[57] ABSTRACT

An offset printing plate comprising a steel base with two layers of chromium, said layers having a combined thickness no more than 1μ.

2 Claims, No Drawings

OFFSET PLATES WITH TWO CHROMIUM LAYERS

This is a continuation of Ser. No. 138,289, filed 12/28/87, which is a continuation of Ser. No. 481,766, filed 4/4/83, which is a continuation of Ser. No. 168,003, filed 7/14/80, all abandoned.

The present invention relates to new offset plates whose hydrophilic surface has been given a "dull finish" by way of a thin chromium layer.

It is known that offset printing processes use plates having a surface of hydrophilic nature. Said surface should advantageously be given a dull finish, as said dull finish advantageously helps the control work at printing time, on the one hand, and the adherence to said surface of a photosensitive layer, on the other hand.

Said dull finish can be obtained by treating the plate support or the surface made from a hydrophilic material with processes whereby the said surface is etched either mechanically, or chemically, or electrochemically.

The use of chromium to produce the hydrophilic surface of an offset plate has also been widely described. The chromium layers used have considerable advantages where hardness, water-acceptance and appearance are concerned. Indeed, said chromium layers can present a dull surface. Two methods are known to produce, electrochemically, a chromium layer with a dull surface, one consisting in using an electrolytic bath at low temperature (between 5° and 8° C. for example) and the other consisting in using an electrolytic bath at a temperature below normal (between 25° and 35° C.) but with an electrical current cut when the deposit is effected. But in all the known cases, the chromium layer (whether with a shiny or a dull surface) which is to play the part of the water-accepting layer in offset plates should have a substantial thickness (definitely over 1μ and generally between 1.5 and 2.8μ).

It has already been suggested to deposit onto supports, hydrophilic layers of chromium of less than 1μ thickness. But considering the examples furnished, specialists are well aware that the very thin layers proposed cannot act as water-accepting hard layers as they scratch too easily and are often porous, thus exposing a sub-jacent surface the properties of which are unacceptable in offset printing.

It has been found and this is precisely the object of the present invention, that it is possible to dull the shiny surface of a hydrophilic material, which surface is to be used as hydrophilic surface for an offset plate, by depositing thereon a layer of dull and porous chromium less than 1μ thick, and preferably less than 0.5μ thick.

The invention therefore consists in depositing over a surface showing the hydrophilic properties required in offset printing, a very thin layer of dull chromium the relative porosity and fragility of which will be accepted precisely because the sub-jacent surface is a water-accepting and ink-refusing surface, but which will be used to give a "dull finish" to the surface of the final material.

Hydrophilic surfaces which can be "dulled" according to the invention are all surfaces which, heretofore, have been considered as hydrophilic surfaces suitable for offset plates.

For example, it is possible to "dull" with a fine layer of chromium, shiny or semi-shiny surfaces of hard materials such as stainless steel, nickel-tin, chromium itself, chromium-chromium oxide surfaces (used as a coating on steel in certain types of cans), phosphorus-nickel, tin alloys and nickel alloys.

It is also possible, if necessary, to "dull" the surfaces of softer shiny materials such as tin or zinc; but considering the "soft" nature of these metals (and in particular of tin) it is preferable to dull only the surface of the thin layers of tin (i.e. of less than 1μ thickness) deposited on a hard surface.

In order to obtain a dull coating of chromium according to the invention, the already known electrochemical techniques are used, which techniques involve either the use of a cold bath or the use of a current cut during the deposit operation. It has however been found that it was possible to obtain the dull chromium deposit directly when using for the baths a temperature below normal (25°–35° C.) and without any current cut, whenever the chromium coating is applied to a chromium or tin surface.

The following examples are given non-restrictively to illustrate the invention.

EXAMPLE 1

A stainless steel plate of 35/100 thickness with a shiny surface is used. Said plate is anode scoured, rinsed and then immersed in a conventional chromium bath (250 g/l of chromic anhydride and 2.5 g of sulfuric acid per liter, temperature: 28°). The plate is connected to the cathode; the current ($15^A$ dcm2) is switched on 15 minutes after the immersion of the plate and it is kept on until the chromium deposit has reached a thickness of 0.3μ, the current being cut 15 seconds after the beginning of the chromium depositing operation.

A plate with a dull finish is obtained. Said plate is covered with a commercial photosensitive printing layer (PCAS) of approximately 1.8μ thickness. After drying (3 mins. at 45° C. and 5 mins. at 85° C.) the plate is ready.

The plate is thereafter used in the conventional manner in offset printing processes : insolation, removal of soluble parts, sizing, etc.

Then the plate is used on an offset printing machine. It is then noted:

that the printing layer adheres solidly to the dull chromium surface, that the exposed hydrophilic parts are definitely ink-refusing.

After a printing run of 60,000 sheets, it was noted that the dull chromium had been scratched by a hard object contained in the paper, said scratch exposing the stainless steel but the printing had not been affected by it.

EXAMPLE 2

An offset quality steel plate produced by the company USINOR is used, of 35/100 thickness.

After scouring, rinsing and an etching rinse, a layer of 0.6μ thick of hard and shiny chromium is applied on both sides of the plate in a bath composed of:

250 gr/l of chromic anhydride
2 g/l of sulfuric acid
Temperature: 45° C.
Density: $-15^A$dcm2.

The plate is thus coated on both its faces with a smooth, hard and shiny layer of chromium which will protect adequately the plate during manipulations.

Said plate is then immersed in an electrolytic bath of chromium of similar composition to that described above, but the operational temperature is 28° C. and a layer of 0.4μ thickness of chromium is deposited, under $30^4$ per dcm2, on only one of the faces of the plate.

There is thus obtained a plate which is protected over all its faces by a smooth layer of chromium, and which is coated on one face with a layer of dull chromium for use in offset printing. Then a photosensitive printing layer is deposited on the dull surface and a ready-to-use offset plate is obtained.

EXAMPLE 3

A chromium plated plate sold by the company SOLLAC is used as starting plate.

After hot scouring (65° C.) in a sodium bicarbonate bath (100 g/l), the plate being made a cathode, said plate is introduced in a chromium bath with a view to depositing on one of its faces, a thin layer (0.3μ for example) of dull chromium.

Similar tests have been conducted using as starting material:

- a steel plate (35/100 thick) produced by the company USINOR, on which has been applied beforehand a layer of 0.9μ of tin-nickel alloy,
- a plate of galvanized steel (thickness 35/100, reference E1, sold by the Société de Fer Blanc), with 2.8 g of tin per m2 over each one of its faces,
- a steel plate of 35/100 whose surface has been sanded; it is possible on such a plate to apply the dull chromium coating according to the invention (of less than 1μ thickness) without using a current cut during the electrolysis,
- a steel plate (35/100 thickness) produced by the company USINOR on both sides of which has been coated a chromium, 0.6μ thick of the micro-cracked type supplied by Etablissements WALBERG, reference W.S.A. 2300 and working at 42°. This type of chromium is very resistant to corrosion,
- a steel plate (35/100 thickness) produced by the company USINOR on both sides of which has been applied a crack-free chromium layer of 0.6μ thickness supplied by Etablissements WALBERG, reference W.S.A. 2650 and working at 65°. This type of chromium is very resistant to corrosion.

All the plates prepared this way have proved to be very good offset plates, capable, without any baking of the photohardened layer, of reaching an output of over 40,000 impressions.

What is claimed is:

1. An offset printing plate, comprising:

A base material of steel:

A first coating of smooth, hard and shiny hydrophilic chromium applied directly to the steel base;

A second coating of dull matte hydrophilic chromium applied directly to the first chromium coating, the combined thickness of the first and second coatings being no more than one micron, said first and second coatings being substantially ink rejecting; and A layer of photosensitive material applied directly to the second coating of chromium, said photosensitive material being hydrophobic and ink receptive after insolation.

2. The offset printing plate of claim 1 wherein the second coating of chromium is of a thickness of 0.5 microns or less.

* * * * *